US005178444A

United States Patent [19]

May et al.

[11] Patent Number: 5,178,444

[45] Date of Patent: Jan. 12, 1993

[54] SECURITY LOCKER FOR GOLF BAG AND CLUBS

[75] Inventors: Richard W. May, Diamond Bar; Ben C. Panlilio, Upland; James H. Sharpe, Orange; Robert J. Sharpe, Corona, all of Calif.

[73] Assignee: Summit Industries Inc., Corona, Calif.

[21] Appl. No.: 660,409

[22] Filed: Feb. 22, 1991

[51] Int. Cl.[5] ..... A47B 48/00

[52] U.S. Cl. ..... 312/265.3; 211/4

[58] Field of Search ..... 312/329, 265.3, 265.4, 312/213; 211/4, 70.2

[56] References Cited

U.S. PATENT DOCUMENTS

| | | | |
|---|---|---|---|
| 2,806,755 | 9/1957 | Glass | 312/265.4 |
| 4,045,103 | 8/1977 | Paolino | 312/213 |
| 5,076,651 | 12/1991 | White | 211/4 |

*Primary Examiner*—Joseph Falk
*Assistant Examiner*—Gerald A. Anderson
*Attorney, Agent, or Firm*—Lyon & Lyon

[57] ABSTRACT

There is disclosed herein a form of cabinet for providing secure storage of a golf bag or bag and clubs therein at a golf course or other facility. A single cabinet or series of cabinets may be provided, with each including a frame assembly, a top, floor and hinged door assembly. The top and door prevent the bags and clubs from being removed from the top and front, respectively, of the cabinet, and suitable cover devices for the back and sides, such as open grids, are provided for preventing removal from the back and sides.

9 Claims, 1 Drawing Sheet

SECURITY LOCKER FOR GOLF BAG AND CLUBS

The present invention relates to a locker or cabinet for providing secure storage of a golf bag and golf clubs in the bag at a golf course or other facility. The cabinet may include a number of individual lockable units for plural golf bags and clubs.

Turning first to the background of this invention, there are not many devices provided at golf clubs and the like for storage of golf bags other than forms of open racks. One such rack comprises a galvanized frame having a plurality of outwardly extending rungs, and a golf bag is set on the bottom of the rack and supported between a pair of the rungs. Another form of golf club rack is somewhat similar to a bicycle rack and comprises an angled bottom support and a set of rails. A golf bag with clubs is set on the bottom support and held between a pair of rails. In all cases the bags are readily accessible.

Unfortunately, the prior devices do not provide for securing either the golf bag or the golf clubs in the golf bag. If one wants to stop for coffee, go to the "19th hole", etc., there is no clear way to ensure security of the bag and clubs.

Accordingly, it is a principal object of the present invention to provide a security locker for containing a golf bag and clubs.

Another object of this invention is to provide an improved and secure storage device for golf bags and clubs.

A further object of this invention is to provide a plurality of modular cabinets to provide security lockers for golf bags and clubs.

These and other objects and advantages of the present invention will become better understood through a consideration of the following description taken in conjunction with the drawings in which.

Figure 1:
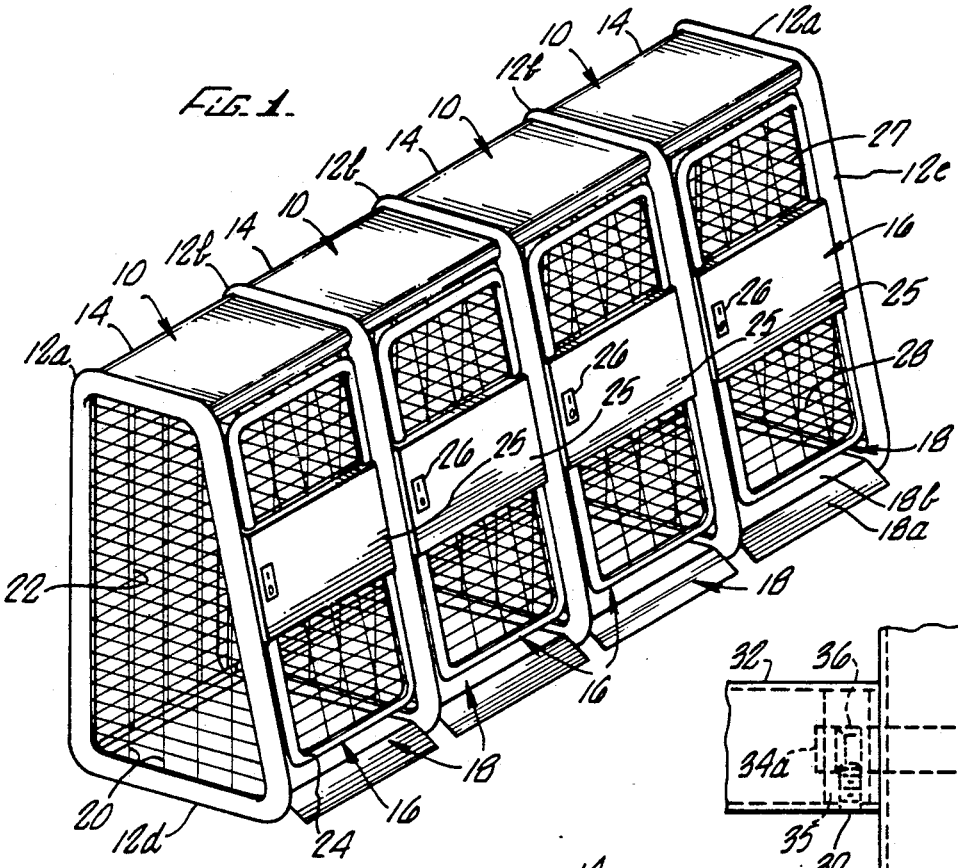
FIG. 1 illustrates a preferred embodiment of a series of security lockers according to the present invention.

Turning now to the drawings, FIG. 1 illustrates a set of four security lockers or cabinets 10. Each of these units is modular and is shown in more detail in FIG. 2. Each comprises a side frame 12*a* or intermediate frame 12*b*, roof panel 14, door 16, bottom ramp 18, side panels 20 and rear panel 22. The door 16 comprises a door frame 24, door panel 25, lock 26 which preferably is a coin operated lock, door grid panels 27–28, and a piano hinge 29 (note FIG. 2). The fronts of the cabinets preferably are angled backward toward the top as shown to reduce the perceived depth thereof.

Figure 3:
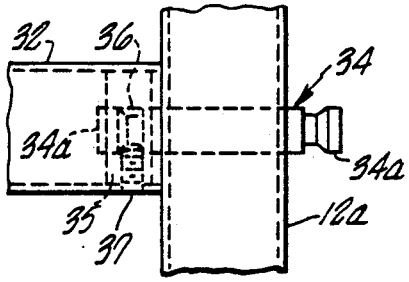
FIG. 3 a detailed illustration of the manner in which bracing can be secured.
Figure 2:
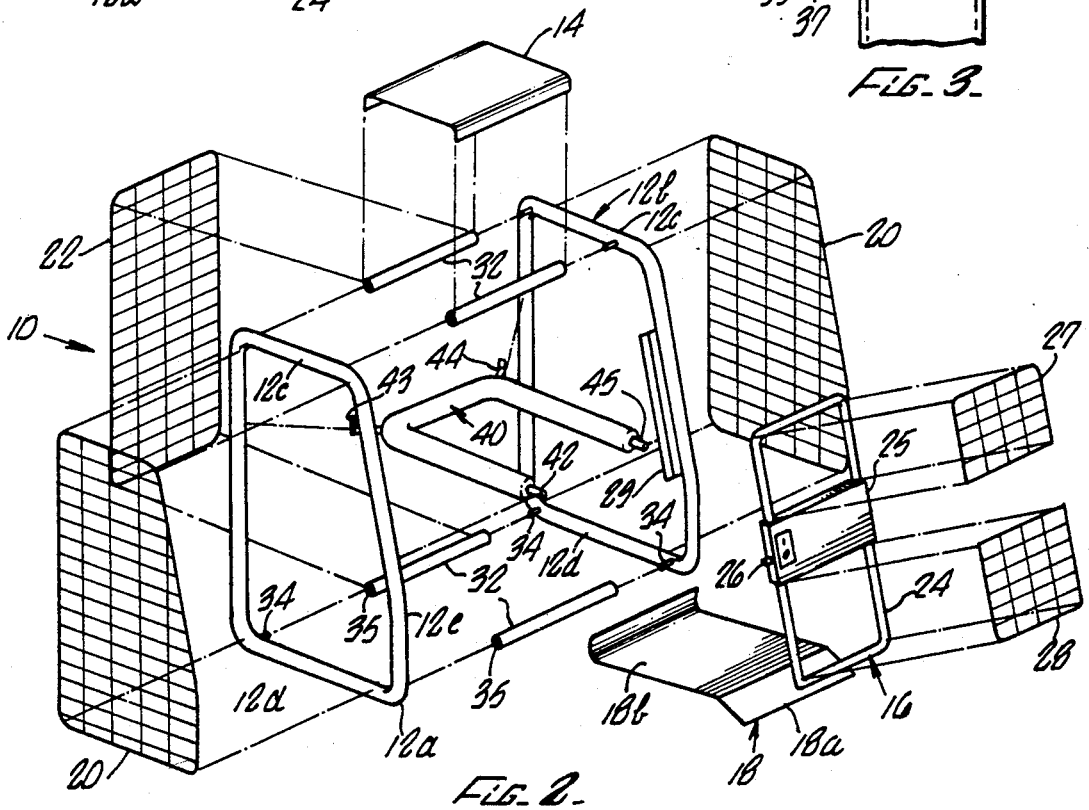
FIG. 2 is an exploded view of an individual locker of the assembly of FIG. 1.

The side frame 12*a* is attached to another side frame (in the case of a single stand alone cabinet) or to an intermediate frame 12*b* (in the case of a series of cabinets as seen in FIG. 1) by inner braces 32 (note in particular FIGS. 2 and 3). Grooved pins 34 (e.g., one-half inch diameter and grooved pins) are secured to the upper and lower sections 12*c* and 12*d*, respectively, of the frames 12*a* and 12*b* as shown in FIG. 2 and as particularly illustrated in FIG. 3. Insets 35 are fixed into the ends of the braces 32 (e.g., one and one-fourth inch 14 gauge tube) as best seen in FIG. 3, and the heads 34*a* of pins 34 slip into respective bores 36 (note FIG. 3) in the inserts 35 and are locked by set screws 37 to secure each brace to the side 12*a* or intermediate frame 12*a*. Preferably the inserts 35 are wedged into the ends of the braces 32 and welded therein. These inserts are donut shaped (with the bore 36), and after welding, a hole is drilled and tapped for set screws 37. This arrangement provides a modular cabinet assembly according to the present invention which can be shipped in a knocked down state. The intermediate frame members 12*b* include longer pins 34 to extend on both sides at the top and bottom sections 12*c* and 12*d* to enable braces 32 to be connected to both sides when forming a set (two or more) of the nature shown in FIG. 1. Alternatively, the braces 32 could be welded to the frames 12*a* and 12*b*, but the pin 34, adapter 35 and set screw 37 arrangement facilitates assembly at the site.

The side panels 20, preferably are welded to the sides of the frames 12, and likewise the back panels 22 are welded to the back of these frames and the roof panels 14 are welded to the upper braces 32. The piano hinge 29 can be attached in any suitable way, as by welding, to the frame 12. Similarly, the access ramp 18 can be welded at least to the rear lower brace 32.

The access ramp 18 preferably comprises a bottom section 18*b* disposed at an angle with respect to the bottom of the cabinet as shown of from about 3° to 8° so as to tilt the golf bag toward the rear of the cabinet when the base of the golf bag is placed on top of the section 18*b* in the cabinet. This helps prevent the bag from falling out of the cabinet when the door 16 is opened. The front 18*a* is inclined downwardly to form a ramp and facilitate placing a bag or golf cart into the cabinet.

Preferably, a bag support 40 is secured to the frames 12 by suitable tabs 42–45. This support can be metal tubing which has a cushioning coating of PVC or other suitable material to form a cushioning member to prevent the bag and clubs from hitting the interior surfaces of the components of the cabinet, namely the frames 12, sides 20 and back 22, and scarring the bag and clubs The door panel 25, as are the panels 27–28, is suitably secured to the door frame 24, as by welding. The lock 26, as noted earlier, preferably is a coin operated lock, and it can engage a slot (not shown) in the front section 12*e* of the frame 12*a* as seen in FIG. 2 (and similar slots in intermediate frames 12*b* for succeeding cabinets in the assembly of FIG. 1).

With respect to materials of constructions, the side frames 12*a* and intermediate frames 12*b* can be constructed of various metal or plastic materials, but typically are formed of tubular steel tube (e.g., 1¼ inch 14 gauge tube). The roof panel 14, floor or ramp 18 and door panel 25 likewise can be made of metal or plastic, but typically are formed of sheet metal. Preferably the ramp 18 is provided with a non-skid surface. The inner bracing 32 and door frame 16 likewise can be formed of metal or plastic, but typically are formed of tubular steel tube (e.g., 1¼ inch 14 gauge tube). The pins 34 and inserts 35 are formed of suitable metal. The lock 26 may be of various forms and configurations, but typically is a coin operated lock as noted earlier. The support 40 typically is formed as described above, but can be formed from other suitable material. The side and back panels 20 and 22 typically are metal grids, as are the door panels 26–28.

As noted earlier, the modular construction of the present cabinet facilitates shipment in a knocked down state, and enables expandability through the modular construction. The floor 18*b* of the access ramp 18 disposed on an angle prevents the golf bag from falling out of the locker when the door 16 is opened. The support 40 cushions the bags and clubs and prevents them from touching the inside of the cabinet. The roof panel 14 prevents rain and other weather elements from entering the golf bag within the cabinet. The cabinet is preferably sized to accommodate a pull cart with golf bag and clubs, and to accommodate various bag sizes ranging from the smallest size (e.g., presently approximately 7½ inches in diameter), to the largest size (e.g., 10½ inches in diameter). The wire grid sides 20 and back 22, as well as the grid door panels 27–28 prevent access to the bag and clubs.

The cabinet unit thus reduces risk from lost or stolen bags and clubs and offers substantial security.

Either the individual cabinet, or a series of cabinets as shown in FIG. 1, can be mounted to a floor surface or a wall surface by using suitable fasteners or brackets. A single cabinet or series of cabinets are particularly useful in public or private golf courses and driving ranges. Cabinets 10 also can be mounted back to back if desired as double units or in double rows. Even though the unit is shown as one for holding bags upright, it could be modified to hold bags in a horizontal position, but still preferably of modular construction and with a slanted access ramp or floor 18*b* so as to tilt the bag and minimize the chance that clubs or other articles would fall out of the bag, or the bag fall out of the door when opened.

While embodiments of the present invention have been shown and described, various modifications may be made without departing from the scope of the present invention, and all such modifications and equivalents are intended to be covered.

What is claimed is:

1. A cabinet for providing storage for a golf bag and golf clubs comprising:

a frame assembly having side frames and brace members for interconnecting the side frames, side and back covers secured to the frame assembly, a top secured to a top portion of the frame assembly, a base secured to a bottom portion of the frame assembly, said base forming an inclined floor disposed to tilt a golf bag rearwardly in the cabinet and forming a forward ramp of different inclination for facilitating insertion of a golf bag and clubs into the cabinet, and a hinged door assembly attached to a front portion of the frame assembly for covering the front portion thereof and being lockable to contain a golf bag within the cabinet.

2. A cabinet as in claim 1 further including a cushioning member disposed within the frame assembly for cushioning the golf bag and preventing a bag and clubs from touching the inside of the cabinet.

3. A cabinet as in claim 2 wherein said floor is inclined at an angle of approximately 3° to 8° with respect to the nominal bottom plane of the cabinet.

4. A cabinet as in claim 1 further including grooved pin members disposed between the side frames and brace members for facilitating assembly of the cabinet.

5. Apparatus as in claim 1 comprising a plurality of like cabinets interconnected together to each individually hold and secure a golf bag and clubs.

6. A cabinet for providing storage for a golf bag and golf clubs comprising:

a frame assembly having tubular side frames and brace members for interconnecting the side frames, tin members affixed between the side frames and brace members for facilitating assembly of the cabinet, and securing the brace members to the side frames, side and back covers in the form of open grids secured to the sides and back of the frame assembly, a top secured to a top portion of the frame assembly, a hinged door assembly attached to a front portion of the frame assembly for covering the front portion thereof and being lockable to contain a golf bag within the cabinet, a cushioning member disposed within the frame assembly for cushioning the golf bag and normally preventing a bag and clubs from touching the inside of the cabinet, and a base secured to a bottom portion of the frame assembly, said base forming an inclined floor disposed to tilt a golf bag rearwardly in the cabinet and into contact with the cushioning member, and said base forming a forward ramp of different inclination for facilitating insertion of a golf bag and clubs into the cabinet.

7. Apparatus as in claim 6 comprising a plurality of like cabinets interconnected together to each individually hold and secure a golf bag and clubs.

8. A cabinet for providing storage for a golf bag and golf clubs comprising:

a frame assembly having side frames and brace members for interconnecting the side frames, a top secured to a top portion of the frame assembly, a base secured to a bottom portion of the frame assembly, said base forming an inclined floor disposed to tilt a golf bag rearwardly in the cabinet and forming a forward ramp of different inclination for facilitating insertion of a golf bag and clubs into the cabinet, a hinged door assembly attached to a front portion of the frame assembly for partially covering the front thereof and being lockable to contain a golf bag within the cabinet, and the frame assembly including cover means for preventing removal of a golf bag from a side or back of the cabinet.

9. A cabinet as in claim 8 wherein said cover means comprises side and back grid covers, and the cabinet further includes a cushioning member disposed within the frame assembly for cushioning the golf bag and preventing a bag and clubs from touching inside surfaces of the cabinet.

* * * * *